United States Patent [19]

Gannon et al.

[11] Patent Number: 5,011,191

[45] Date of Patent: Apr. 30, 1991

[54] VIEW-THROUGH INFORMATION CONVERTER

[76] Inventors: James M. Gannon; Germaine A. Gannon, both of 21 W. 542 22nd St., Glen Ellyn, Ill. 60137

[21] Appl. No.: 527,588

[22] Filed: May 23, 1990

[51] Int. Cl.[5] ..... B42D 15/00

[52] U.S. Cl. ..... 283/115; 33/1 B; 283/117

[58] Field of Search ..... 283/115, 117; 434/157, 434/262, 321; 40/594, 638, 615; 273/240; 33/1 B

[56] References Cited

U.S. PATENT DOCUMENTS

| | | | |
|---|---|---|---|
| 429,401 | 6/1890 | Widule . | |
| 650,664 | 5/1900 | Wireback . | |
| 1,084,665 | 1/1914 | Sheldon . | |
| 1,445,095 | 2/1923 | McCarty . | |
| 1,548,487 | 8/1925 | Ross . | |
| 3,126,862 | 3/1964 | Hanley | 116/119 |
| 3,324,823 | 6/1967 | Peters | 116/119 |
| 3,820,824 | 6/1974 | Maxwell | 283/36 |
| 4,177,578 | 12/1979 | Yamamoto | 434/157 |
| 4,255,653 | 3/1981 | Borkat et al. | 235/495 |
| 4,272,107 | 6/1981 | Elbow | 283/115 |
| 4,334,771 | 6/1982 | Ryan, Jr. | 283/115 |
| 4,475,288 | 10/1984 | Pellegrom | 283/115 |
| 4,544,360 | 10/1985 | Goodman | 434/178 |
| 4,549,500 | 10/1985 | Lowin et al. | 116/240 |
| 4,559,705 | 12/1985 | Hodge et al. | 33/1 B |
| 4,586,906 | 5/1986 | Buccieri, Jr. | 283/903 |
| 4,604,063 | 8/1986 | Gurmarnik | 434/262 |
| 4,607,433 | 8/1986 | Meeker | 33/1 BB |
| 4,813,711 | 3/1989 | Bohlman | 283/81 |
| 4,832,373 | 5/1989 | Swan | 283/115 |

*Primary Examiner*—Douglas D. Watts
*Assistant Examiner*—Hwei-Siu Payer
*Attorney, Agent, or Firm*—David J. Marr

[57] ABSTRACT

An information converter for use with a pre-printed information listing, such as a television programming guide listings chart comprising a transparent film means such as a plastic sheet for superimposing onto the listings chart such that substantially all of the listings presented on the television listings chart are viewable through the plastic sheet. The information converter further comprises first cross-reference means for converting television station numbers and call letters presented on the listings chart into numbers which are directly usable by the reader to identify television tuner locations where each television station listed in the listings chart can be received on his or her television set. Further, the information converter can include second cross-reference means for converting the call letters of television stations not listed in the listings chart directly into numerical information needed to locate the stations on a television set. Preferably, the information converter also extends a sufficient distance beyond the dimensions of the listings chart so that advertising or other graphic material can be included without blocking any of the information appearing on the listings chart. The extension of the information converter can also be of sufficient distance to enable the plastic sheet to function as a book marker when the listings chart with which it is used is located within a multi-page television programming guide.

8 Claims, 3 Drawing Sheets

10

20
22
ETIOLIX TINIOLI--7A-3614
FOIIL YLPINCLY--6432-700
6:
2- 2
5- 5
7- 7
9- 9
11- 11
13- 20
26- 26
3- 32
38- 38
46- 44
33- 50
36- 66
18
44- AE
45- AMC
40- BET
24- BRV
41- CNN
23- DIS
15- DSC
8- ESPN
31- FAM
20- HBO
30- LIFE
25- MAX
35- NICK
29- SC
21- SHO
17- TBS
22- TMC
43- TNN
34- TNT
27- USA
WOR
16
12

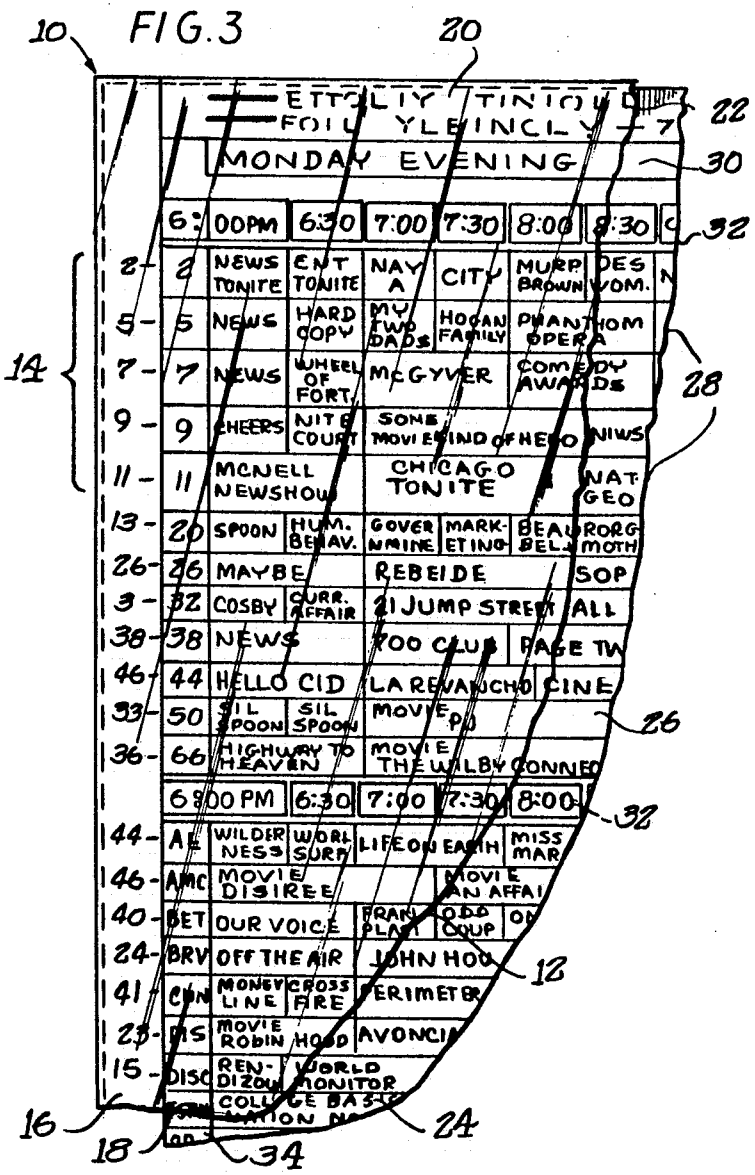
FIG. 3
MONDAY EVENING
6:00PM
6:30
7:00
7:30
8:00
8:30
NEWS TONITE
ENT TONITE
NAY A
CITY
MURP BROWN
DES WOM.
NEWS
HARD COPY
MY TWO DADS
HOGAN FAMILY
PHANTOM OPERA
NEWS
WHEEL OF FORT.
MCGYVER
COMEDY AWARDS
CHEERS
NIT COURT
SONS
CHICAGO TONITE
MCNELL NEWSHOUR
SPOON
HUM. BEHAV.
GOVER MAINE
MARK ETING
BEAU BELL
ROBG MOTH
MAYBE
REBEIDE
SOP
COSBY
CURR. AFFAIR
21 JUMP STREET
ALL
NEWS
HELLO CID
LA REWARD
CHO
CINE
SIL SPOON
SIL SPOON
MOVIE
HIGHWAY TO HEAVEN
MOVIE
THE WALTBY CONNER
WILDER NESS
WORL SURV
LIFE ON EARTH
MISS MAR
MOVIE DISIREE
MOVIE
OUR VOICE
FRAN PLAT
OUP
OFF THE AIR
JOHN HOO
MONEY LINE
CROSS FIRE
PERIMETER
MOVIE ROBIN HOOD
AVONCI
REN-DIZON
WORLD MONITOR
COLLEGE BASS
10
12
14
16
18
20
22
24
26
28
30
32
34

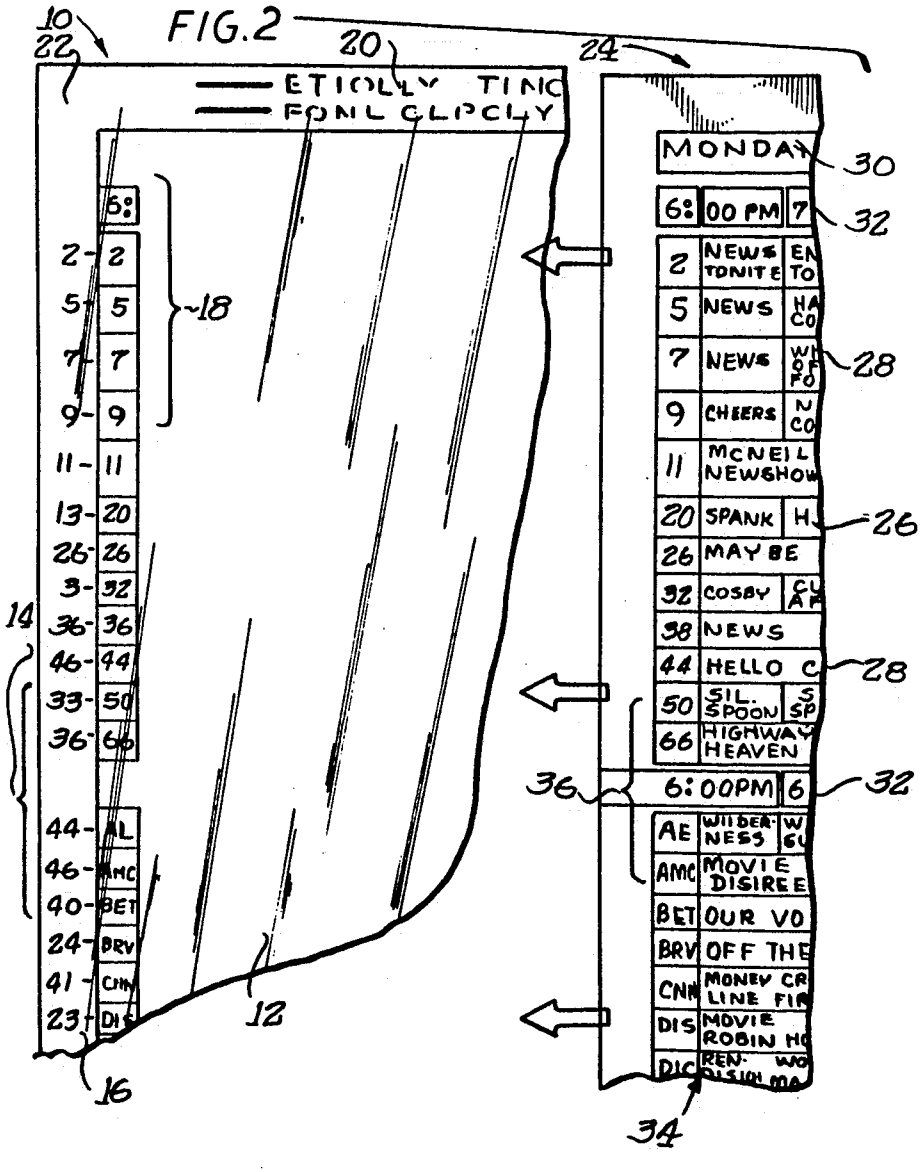
FIG. 2
MONDAY
6:00 PM
NEWS TONITE
NEWS
NEWS
CHEERS
MCNEIL NEWSHOUR
SPANK
MAYBE
COSBY
NEWS
HELLO C
SIL. SPOON
HIGHWAY HEAVEN
6:00PM
WILDER NESS
MOVIE DISIREE
OUR VO
OFF THE
MONEY LINE
MOVIE ROBIN HO
REN-DIZON
10
12
14
16
18
20
22
24
26
28
30
32
34
36

VIEW-THROUGH INFORMATION CONVERTER

BACKGROUND OF THE INVENTION

1. Field of the Invention This invention relates in general to an information converter and more particularly to a device for converting television tuner location information provided in a pre-printed programming guide into tuner location information which is directly usable in a specific community.

2. Description of Related Art With the onset of the cable television industry, many television viewers are now provided with a wide variety of television stations and networks from which to choose. Typically, a television tuner connected to a cable transmission service can access over 50 different program channels at any one time. With this advance in technology, however, the task of providing a cable television viewer with a convenient programming guide for locating the television channels where each of the various programs can be found has become increasingly difficult. The problem has been complicated further by the fact that many cable transmission service companies have engaged in the practice of transmitting programs on frequencies which are distinct from the frequencies on which the same programs can be received over the airwaves.

In an attempt to present such a large amount of information in a concise, easily readable manner, many television programming guides across the nation, such as those provided in newspapers or available at newsstands, now include charts having vertical and horizontal columns and rows listing the stations and times of the programming described thereon. While these programming charts have facilitated use of the guides, it is still sometimes difficult to make use of the programming presented stemming mainly from the fact that the stations listed in the guides do not always correspond to the tuner location where the programming can be found. In addition, many guides list only a television station's call letters such as "ESPN" leaving the viewer with the task of trying to determine on which station the programming appears. Moreover, most commercially available programming guides do not provide a complete reference to all the programming accessible in a particular community. Most guides, therefore, do not provide the viewer with a convenient way to locate all the stations which are available.

SUMMARY OF THE INVENTION

It is a general objective of the present invention to provide an information converter for use with a pre-printed information listing.

It is a more specific objective of the present invention to provide a device for converting numerical and alphabetical information relating to television stations and networks into data which is directly usable to locate a specific television station.

Other objectives and advantages of this invention will become apparent upon reading the following detailed description and upon reference to the drawings. Throughout the description, like reference numerals refer to like parts.

Summarily stated, the present invention comprises transparent film means for superimposing onto a pre-printed information listing such that substantially all of the pre-printed information remains viewable through the transparent film means, cross-reference means for converting a predetermined portion of said information listing into data which is directly usable, and alignment means for matching said cross-reference means with said predetermined portion of information to be converted.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following descriptions taken in connection with the accompanying drawings, in which:

FIG. 2 shows a partial view of the embodiment shown in FIG. 1 positioned adjacent to a partial view of an exemplary pre-printed information listing with which the invention is utilized;

FIG. 3 illustrates a partial view of the invention superimposed on the example of the pre-printed information listing shown in FIG. 2.

DETAILED DESCRIPTION OF THE ILLUSTRATED EMBODIMENT

While the invention will be described in connection with a preferred embodiment, it will be understood that it is not intended to limit the invention with that embodiment. On the contrary, it is intended to cover all alternatives, modifications and equivalents as may be included in the spirit and scope of the invention.

Figure 1:
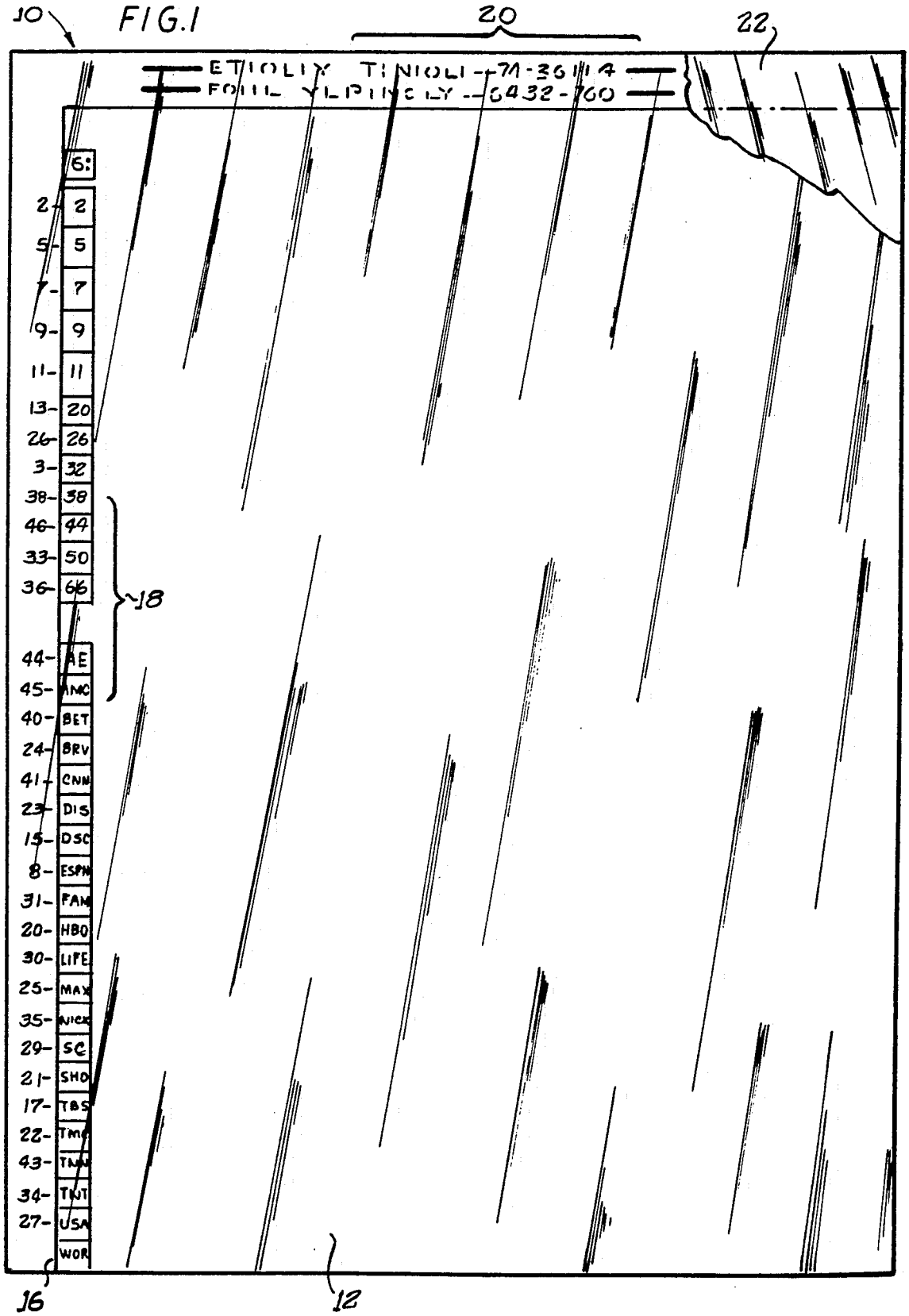
FIG. 1 is an elevational view of a preferred embodiment of the present invention.

Referring to FIG. 1, an information converter is shown as generally designated by reference numeral 10. The information converter 10 comprises a transparent film or overlay means 12 which is preferably formed of a clear, pliable, plastic material of single or double thickness as is discussed in greater detail below. As illustrated, a first cross-reference means 14 is disposed along a left margin 16 of the film means 12. Alignment means 18 are also provided in the form of a vertical column of numerical and alphabetical information inward of first cross-reference means 14 along left margin 16. In addition, the information converter 10 further comprises a graphic region 20 shown along an upper margin 22 of the film means 12. The numerical and alphabetical information shown in first cross-reference means 14, alignment means 18 and graphic region 20 is, of course, by way of example only.

Upon reference to FIGS. 2 and 3, it can easily be understood that the preferred embodiment of the information converter 10 is intended for use with a pre-printed information listing 24, which is shown in the form of a modern television programming listings chart arranged in typical fashion. The listings chart 24 first comprises a central region 26 having rows of television program descriptions 28 scheduled to be broadcast on a particular day of the week. The day for which the descriptions 28 apply is identified in a top portion 30, below which a time bar 32 is presented to enable the reader to determine what hour of the day the programs will air.

The central region 26 of the listing 24 is usually divided into upper and lower regions, with another time bar 32 appearing in between. This division of the central region 26 serves to separate those program descriptions 28 which can be received by a television tuner without a cable television connection, from those only received by a television tuner provided with a cable television hook-up.

To the left of the central region 26 of the listings chart 24, a vertical station identification column 34 is included having either numerical or alphabetical indicia 36 corresponding to each row of the programming descriptions 28. One may assume that the intent of the listings publisher in providing the station identification column 34 is to give the reader information regarding the location of the channels, or tuner positions, where the programs described by the corresponding descriptions 28 can be found on a conventional television set. Such information, however, is obviously of an indirect nature in the case of the alphabetical indicia provided in column 34. That is, in all instances, the reader of the programs listing guide 24 must somehow convert the alphabetical information taken from column 34 into numerical data in order to locate the television station desired to be viewed.

Moreover, it is now common for many cable television services to transmit programming on frequencies which are distinct from those frequencies over which a television broadcast can be received by a television equipped with only a standard television antenna. Therefore, in many cases, even the numeral information taken from column 34 by a reader must be converted before the proper tuner setting can be determined.

For these reasons, the information converter 10 of the present invention is provided with first cross-reference means 14 for quickly and conveniently converting the numerical and alphabetical indicia provided in the station identification column 34 into directly usable numerical data. The numerical data obtained from the first cross-reference means 14 can be directly applied to locate the desired tuner position on a conventional television set thereby greatly facilitating use of the listings chart 24.

In operation, the information converter 10 is merely superimposed onto the listings chart 24 as shown in FIG. 3 such that the first cross-reference means 14 is properly aligned with the station identification column 34. The transparent film 12 allows all the program descriptions 28 to be easily viewed through the information converter 10 and the desired conversion may now be easily accomplished. It will be appreciated by one of ordinary skill in the art that the alignment means 18 can take several forms, and that the illustrated embodiment comprising duplication of the indicia contained in the station identification column 34 is only one example.

It will also be understood that the information converter 10 can be easily modified to conform with the specific channel conversions necessary for a particular cable service provider and/or geographical area. Such modifications merely requires the numerical indicia provided on the first cross-reference means 14 to be altered to suit the cable service channel designations targeted.

Therefore, yet another important and advantageous aspect of the present invention is the provision of a graphic region 20. As illustrated best in FIG. 3, a graphic region 20 is located on the film means 12 above the top portion 30 of the program listing 24. Graphic region 20 therefore does not interfere with an examination of the listing 24 and provides an ideal location to advertise which cable service company's transmissions the particular form of the information converter 10 is adapted for use with. Further extension and/or alternative location of the graphic region 20 can provide additional space for advertising of any kind and/or enable the information converter 10 to function as a book marker when the listing 24 with which it is utilized is incorporated into a multi-page publication.

Preferably, the information converter 10 is formed from a single ply of plastic material and has both the first cross-reference means 14 indicia and graphic region 20 advertising material discussed above printed directly thereon by conventional printing processes. The information converter 10 can, however, also take the form of a multiple-ply laminate, in which case the first cross-reference means 14 indicia and graphic region 20 advertising material can be sandwiched in predetermined locations therebetween.

Figure 4:
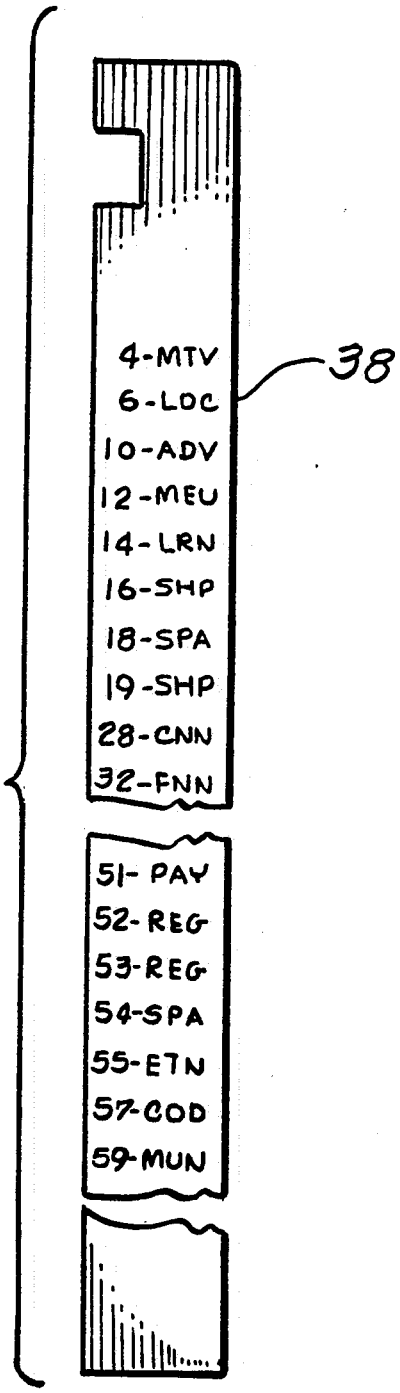
FIG. 4 shows a second cross-reference means aspect of the invention.

In accordance with another important feature of the present invention, it should be noted that many preprinted programming listings 24 do not contain listings for all the stations which are provided by a particular cable service. For this reason, the information converter 10 may also comprise a second cross-reference means 38 as illustrated in FIG. 4. The second cross-reference means 38 can be positioned on a reverse surface of the transparent film 12 in any manner (such as those discussed above) and will function to provide the viewer with a quick and convenient means of converting the call letters of the additional stations provided into the numerical tuner locations where these stations can be viewed.

The invention is claimed as follows:

1. An information converter in combination with a pre-printed information listing, said information converter comprising transparent film means for superimposing onto said pre-printed information listing such that substantially all of the information presented on said information listing is viewable through said transparent film means, first cross-reference means on one side of said transparent film means for converting a predetermined portion of the information presented on said information listing into directly usable data thereby facilitating utilization of the information presented on said information listing, said first cross-reference means comprising a series of graphic indicia corresponding to graphic indicia appearing on the pre-printed information listing, and alignment means for enabling proper alignment of said first cross-reference means with the predetermined portion of the information listing to be converted.

2. An information converter in combination with a pre-printed information listing as recited in claim 1, wherein said pre-printed information listing comprises a television programming guide, said programming guide having a series of individual programming listings for each television station included in said programming guide and either numerical or alphabetical indicia corresponding to each of the series of individual programming listings.

3. An information converter in combination with a pre-printed information listing as recited in claim 2, wherein said first cross-reference means further comprises numerical indicia corresponding to each of said numerical or alphabetical indicia listed in said programming guide, said numerical indicia of said cross-reference means being directly usable to identify a television tuner location where each television station listed in said programming guide can be received.

4. An information converter in combination with a pre-printed information listing as recited in claim 3, wherein said alignment means for enabling proper alignment of said first cross-reference means with aid numerical or alphabetical indicia listed in said programming guide comprises a duplication of said numerical or alphabetical indicia corresponding to each of the series of individual listings.

5. An information converter in combination with a pre-printed information listing as recited in claim 4, further comprising a secondary cross-reference means for converting alphabetical indicia corresponding to television stations not listed in said programming guide into numerical indicia which is directly usable to identify television tuner locations for each of the stations.

6. An information converter in combination with a pre-printed information listing as recited in claim 5, wherein said second cross-reference means is positioned on a reverse side of said transparent film means.

7. An information converter in combination with a pre-printed information listing as recited in claim 1, wherein said transparent film means extends a sufficient predetermined distance beyond said pre-printed listing to enable said transparent film means to include graphic material such as advertising without blocking any of said information appearing on said pre-printed information listing.

8. An information converter in combination with a pre-printed information listing as recited in claim 1, wherein said transparent film means extends a sufficient predetermined distance beyond said pre-printed information listing to enable identification of said information converter when said pre-printed information listing is located within a multi-page publication.

* * * * *